US007389657B2

(12) United States Patent
Lonati et al.

(10) Patent No.: US 7,389,657 B2
(45) Date of Patent: Jun. 24, 2008

(54) METHOD FOR PRODUCING OPEN-KNIT FABRIC WITH MACHINES FOR KNITTING HOSIERY OR OTHER ARTICLES, AND OPEN-KNIT ARTICLE OBTAINED WITH THE METHOD

(75) Inventors: Ettore Lonati, Brescia (IT); Fausto Lonati, Brescia (IT); Tiberio Lonati, Brescia (IT)

(73) Assignee: Santoni S.p.A., Brescia (IT)

( * ) Notice: Subject to any disclaimer, the term of this patent is extended or adjusted under 35 U.S.C. 154(b) by 0 days.

(21) Appl. No.: 10/588,185

(22) PCT Filed: Jan. 28, 2005

(86) PCT No.: PCT/EP2005/000869

§ 371 (c)(1),
(2), (4) Date: Aug. 2, 2006

(87) PCT Pub. No.: WO2005/080653

PCT Pub. Date: Sep. 1, 2005

(65) Prior Publication Data

US 2007/0163303 A1 Jul. 19, 2007

(30) Foreign Application Priority Data

Feb. 23, 2004 (IT) ..... MI04A0303

(51) Int. Cl.
*D04B 1/10* (2006.01)

(52) U.S. Cl. ..... 66/215; 66/173

(58) Field of Classification Search ..... 66/8, 66/173, 121, 123, 215, 25, 169 R
See application file for complete search history.

(56) References Cited

U.S. PATENT DOCUMENTS 1,852,936 A 4/1932 Nebel (Continued)

FOREIGN PATENT DOCUMENTS

WO WO 02/04727 A 1/2002

*Primary Examiner*—Danny Worrell
(74) *Attorney, Agent, or Firm*—Modiano & Associati; Albert Josif; Daniel J. O'Byrne

(57) ABSTRACT

A method for producing open-knit fabric with machines for knitting hosiery or other articles and an open-knit article obtained with the method. The method consists in producing in succession rows of knitting (A,B,C) by means of a plurality of needles (1,2), with openwork being performed which is constituted by holes, each of which is provided by means of a group of needles (1,2) in which a first needle (1), after taking part in the formation of a first row (A) of knitting, is freed from the loop (1*a*) of the first row (A) of knitting by transferring the loop to a second needle (2) that is contiguous to the first needle (1). The first needle (1) is actuated so as to resume knitting, forming a new loop (1*b*) of a row (B) of knitting that is subsequent to the first row (A). It is optionally possible to gradually free a plurality of needles, by transferring the corresponding loop to a contiguous needle, and/or to vary the number of rows of knitting after which the needles freed from the related loop resume knitting, and/or to varying the stitch that is produced by these needles when knitting resumes, so as to vary the dimensions and/or shape of the holes that constitute the openwork.

8 Claims, 7 Drawing Sheets

U.S. PATENT DOCUMENTS 2,021,598 A * 11/1935 Gustav ..... 66/180
3,035,427 A 5/1962 Chiodine
3,137,150 A 6/1964 Mishcon
4,015,444 A * 4/1977 Johnson ..... 66/42 R
4,941,331 A * 7/1990 Cournoyer et al. ..... 66/25
6,170,299 B1 * 1/2001 Apollonio ..... 66/13
6,539,752 B1 * 4/2003 Apollonio ..... 66/215
6,662,599 B1 * 12/2003 Apollonio ..... 66/215
6,871,515 B1 * 3/2005 Starbuck et al. ..... 66/169 R

* cited by examiner

METHOD FOR PRODUCING OPEN-KNIT FABRIC WITH MACHINES FOR KNITTING HOSIERY OR OTHER ARTICLES, AND OPEN-KNIT ARTICLE OBTAINED WITH THE METHOD

The present invention relates to a method for producing open-knit fabric with machines for knitting hosiery or other articles, and to an open-knit article obtained with the method.

BACKGROUND OF THE INVENTION

Machines for knitting hosiery or other articles are known which are capable of transferring a loop from the needle that formed it to a contiguous needle. A machine of this kind is disclosed for example in the published patent document no. WO 02/070799.

In the field of the production of knitted textile articles, in particular in the field of knitwear and hosiery, there is a constant demand for articles that are aesthetically enhanced by means of decorations, among which openwork is particularly appreciated. There is therefore a constant search, on the part of knitting experts, for new weaves of knitting in order to devise openwork with holes of various sizes and for new shapes to obtain innovative aesthetic effects.

SUMMARY OF THE INVENTION

The aim of the present invention is to meet these requirements by providing a method that by using the method of transferring the loop from one needle to a contiguous needle in combination with the formation of conventional stitches allows to produce open-knit fabric.

Within this aim, an object of the invention is to provide a method that allows to obtain openwork with holes of various sizes and shapes, capable of meeting the most disparate aesthetic requirements.

Another object of the invention is to provide a method that can be performed in the production of knitted items of clothing both on circular machines and on rectilinear machines.

This aim and these and other objects that will become better apparent hereinafter are achieved by a method for producing open-knit fabric with machines for knitting hosiery or other articles, which consists in producing in succession rows of knitting by means of a plurality of needles of the machine that is used, characterized in that it consists in performing openwork constituted by holes, each of which is provided by means of a group of needles in which a first needle, after taking part in the formation of a first row of knitting, is freed from the loop of said first row of knitting by transferring said loop to a second needle that is contiguous to said first needle, said first needle being actuated so as to resume knitting, forming a new loop of a row of knitting that is subsequent to said first row.

BRIEF DESCRIPTION OF THE DRAWINGS

Further characteristics and advantages of the invention will become better apparent from the description of some preferred but not exclusive embodiments of the method according to the invention, illustrated by way of nonlimiting example in the accompanying drawings, wherein.

DESCRIPTION OF THE PREFERRED EMBODIMENTS

Figure 1:
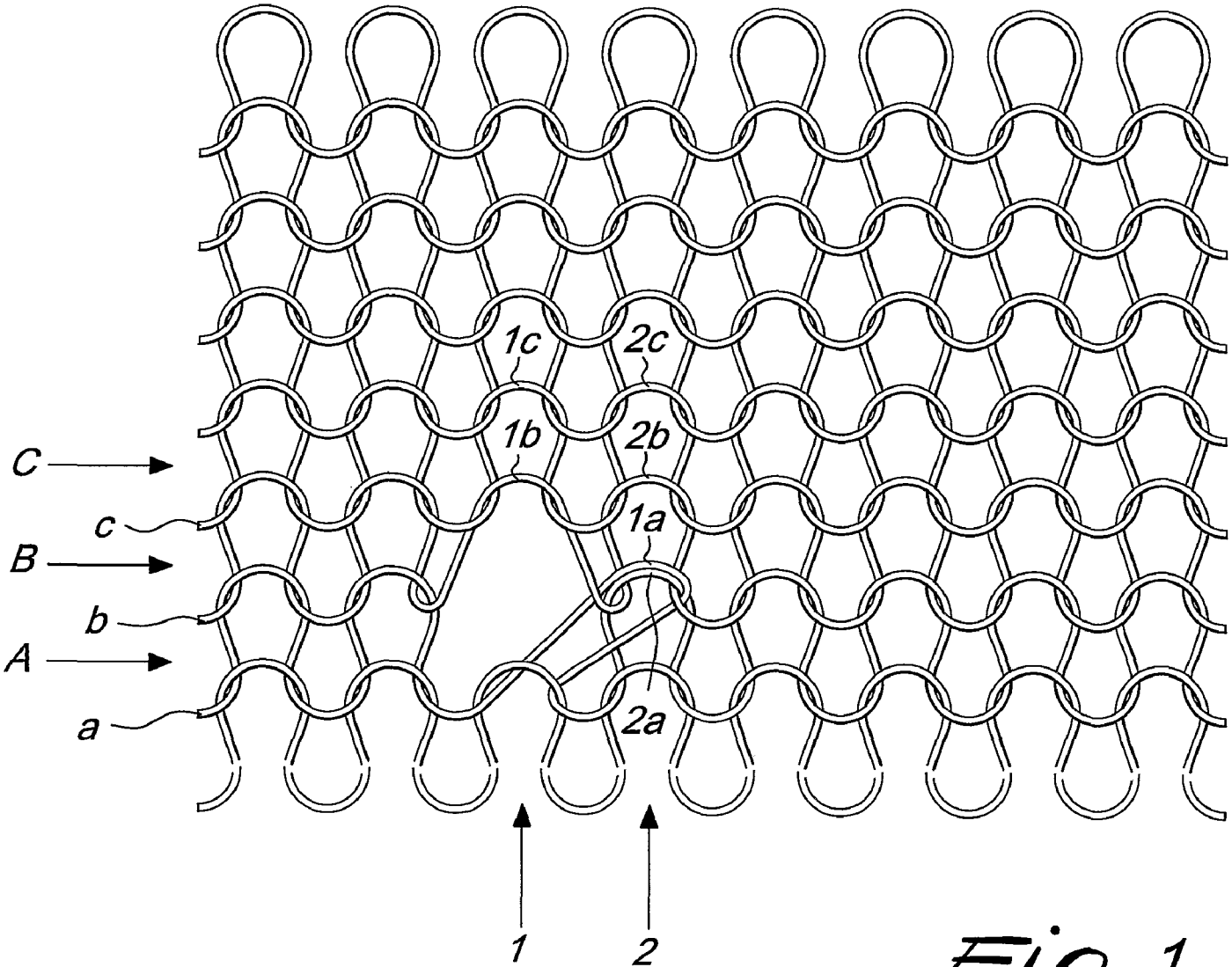
FIGS. 1 to 7 are views of portions of a knitted fabric, shown highly enlarged and from the reverse side, each portion having a different type of hole obtained with an embodiment of the method according to the invention.

With reference to the figures, the method according to the invention consists in producing, in succession, rows of knitting in order to produce a knitted fabric; during said rows, openwork is performed which is constituted by holes, each of which is obtained by means of a group of needles in which a first needle, after taking part in the formation of a first row of knitting, is freed from the loop just formed during the formation of the first row, transferring said loop to a second needle that is contiguous to the first needle. The first needle is actuated again to resume knitting, forming a new loop in the formation of a row of knitting that is subsequent to the first row of knitting.

The first needle can resume knitting, after the transfer of the loop formed during the formation of the first row, during the formation of the row of knitting that directly follows the first row of knitting, or during the formation of a row of knitting that is spaced from the first row of knitting by a preset number of intermediate rows of knitting.

Furthermore, the transfer of the loop from one needle to a contiguous needle can also affect the needles that are contiguous to the first needle after forming rows of knitting that are subsequent to the first row of knitting, so as to gradually free more needles.

The delay in resuming knitting on the part of the needle or needles freed by the transfer of the corresponding loop and/or the gradual increase in the needles freed by the transfer of the corresponding loop allow to increase the dimensions of the hole. Moreover, these solutions and any variation in the type of stitch performed by said needles when knitting resumes allow to also vary the shape of the hole.

FIGS. 1 to 7 illustrate by way of example seven types of hole that can be obtained with the method according to the invention.

In the description that follows, for the sake of simplicity and greater clarity, it is assumed that the loops formed by each needle in the production of a row of knitting are provided by means of a single thread, but the method according to the invention can also be performed by forming loops that are each composed of two or more threads fed simultaneously to the needles.

In the figures, the rows of knitting have been designated by uppercase letters. For the sake of simplicity in description, each needle is designated hereinafter by the numeral that designates, in the drawings, the column of loops knitted by the same needle. The thread of each row of knitting is designated by a lowercase letter that is the same as the uppercase letter that designates the row of knitting. The loop of a row of knitting formed by a needle is designated by the numeral of the column of loops to which it belongs (i.e., with the numeral that also designates the needle that forms said column of loops) and by a lowercase letter that is the same as the uppercase letter that designates said row of knitting.

In the description that follows it is assumed, for the sake of simplicity, that the needles that form the knitting are arranged vertically, as occurs in a needle cylinder of a circular knitting machine for hosiery or other articles, and therefore for example the expressions "needle lifting" for needle engagement and "needle lowering" for forming the loop are used, without altering the fact that the various described types of knitting can also be performed by means of needles that are arranged horizontally or are variously inclined with respect to the vertical.

The hole shown in FIG. 1 is obtained, during the formation of the knitting, by using a group of needles constituted by two needles, respectively a first needle 1 and a second needle 2, which are contiguous.

In order to form said hole, the first needle 1, after taking part with other needles in the formation of a first row of knitting A with a thread "a", is freed from the loop 1*a*, formed during the formation of said row of knitting A, by transferring the loop 1*a* onto the second needle 2, which in this manner carries its own loop 2*a* and the loop 1*a*.

After the first row of knitting A, a second row of knitting B is formed by means of a thread "b" by actuating, together with the other needles that take part in the formation of the row of knitting B, the first needle 1 and the second needle 2, which form respective loops 1*b* and 2*b*. The first needle 1 and the second needle 2, during the engagement of the thread "b", are both lifted to the drop-stitch level, so that the loops 1*a* and 2*a* pass below the latch of the second needle 2. The formation of the loop 1*b*, as a consequence of the descent of the needle 1, since the needle 1 is free, does not form an actual stitch, but simply forms a so-called "bend", while the formation of the loop 2*b* drops the loops 1*a*, 2*a* with which the loop 2*b* is knitted in.

A third row of knitting C is then formed with a thread "c", which is knitted not only by other needles that take part in the formation of the row of knitting C but also by both of the needles 1 and 2, which are lifted so as to engage the thread "c" at a drop-stitch level, so that the loops 1*b* and 2*b* pass below the latch of the corresponding needle. The subsequent lowering of said needles 1 and 2 forms two loops 1*c* and 2*c*, which are knitted in respectively with the loops 1*b* and 2*b*, which are dropped by said needles. At this point, the hole shown in FIG. 1 is complete.

Figure 2:
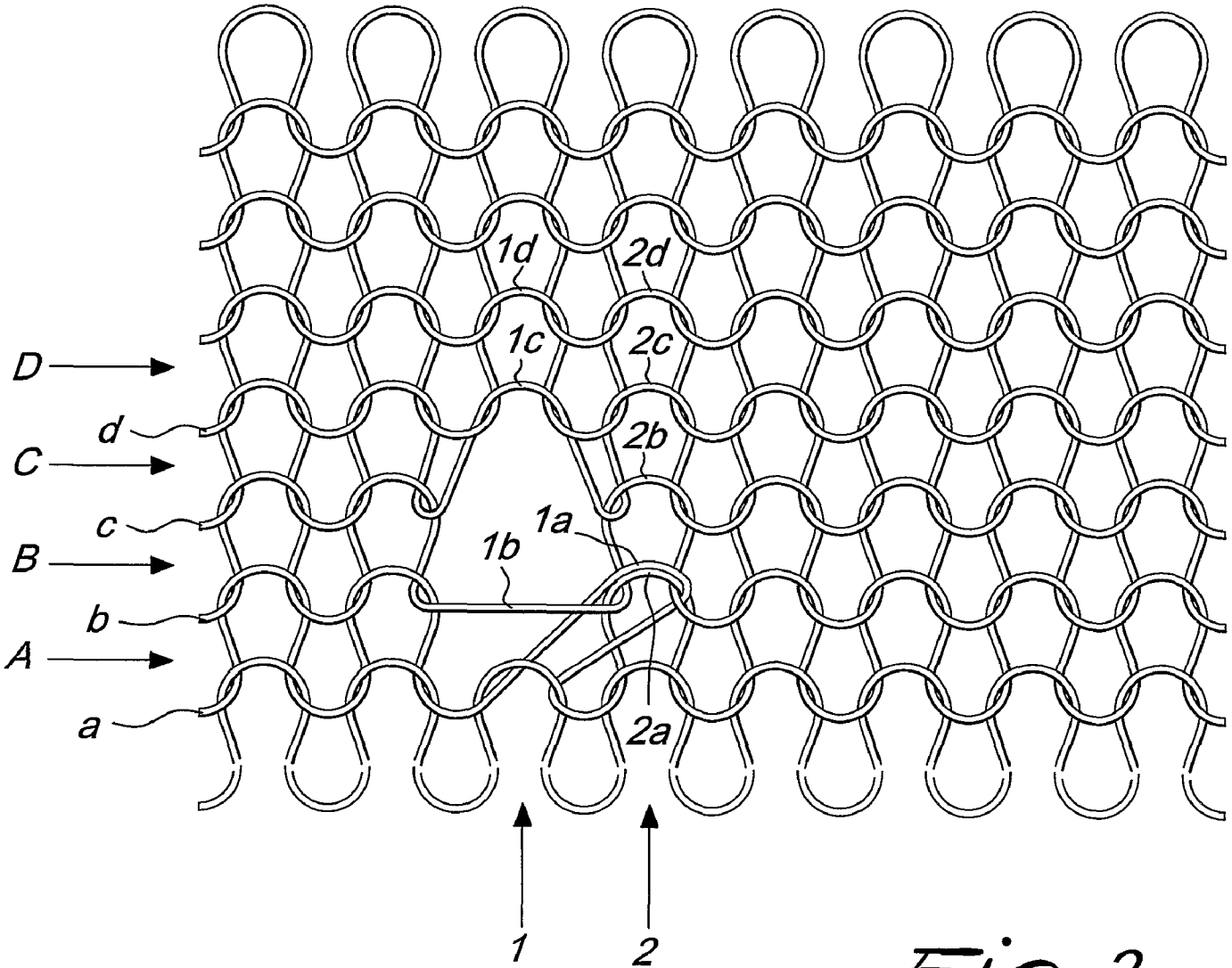

The hole shown in FIG. 2 is obtained, during the formation of the knitting, by using a group of needles again constituted by two needles, respectively a first needle 1 and a second needle 2, which are contiguous.

In order to form said hole, the first needle 1, after taking part with other needles in the formation of a first row of knitting A with a thread "a", is freed from the loop 1*a*, formed during the formation of said row of knitting A, by transferring the loop 1*a* onto the second needle 2, which in this manner carries its own loop 2*a* and the loop 1*a*.

After the first row of knitting A, a second row of knitting B is formed by means of a thread "b". The first needle 1 is excluded from the knitting of the second row of knitting B, while the second needle 2 is actuated together with the other needles that take part in the formation of the row of knitting B. In this manner, a bridle 1*b* is formed at the first needle knitting 1, while the second needle 2 forms a loop 2*b*. The second needle 2, during the engagement of the thread "b", is lifted to the drop-stitch level, so that the loops 1*a* and 2*a* pass below the latch of the second needle 2. The formation of the loop 2*b* drops the loops 1*a*, 2*a*, with which the loop 2*b* is knitted in.

A third row of knitting C is then formed with a thread "c", which is knitted not only by other needles that take part in the formation of the row of knitting C but also by both needles 1 and 2, which are lifted to engage the thread "c" at a drop-stitch level, so that the loop 2*b* passes below the latch of the second needle 2. The subsequent lowering of said needles 1 and 2 forms two loops 1*c* and 2*c*. The formation of the loop 1*c* following the descent of the needle 1, since the needle 1 is free, does not form an actual stitch, but simply forms a so-called "bend", while the formation of the loop 2*c* drops the loop 2*b* with which the loop 2*c* is knitted in.

After the third row of knitting C, a fourth row of knitting D is formed with a thread "d" that is knitted not only by other needles that take part in the formation of the row of knitting D but also by both of the needles 1 and 2, which are lifted to engage the thread "d" at a drop-stitch level, so that the loops 1*c* and 2*c* pass below the latch of the corresponding needle. The subsequent lowering of said needles 1 and 2 forms two loops 1*d* and 2*d*, which are knitted in respectively with the loops 1*c* and 2*c*, which are dropped by said needles. At this point, the hole shown in FIG. 2 is completed.

Figure 3:
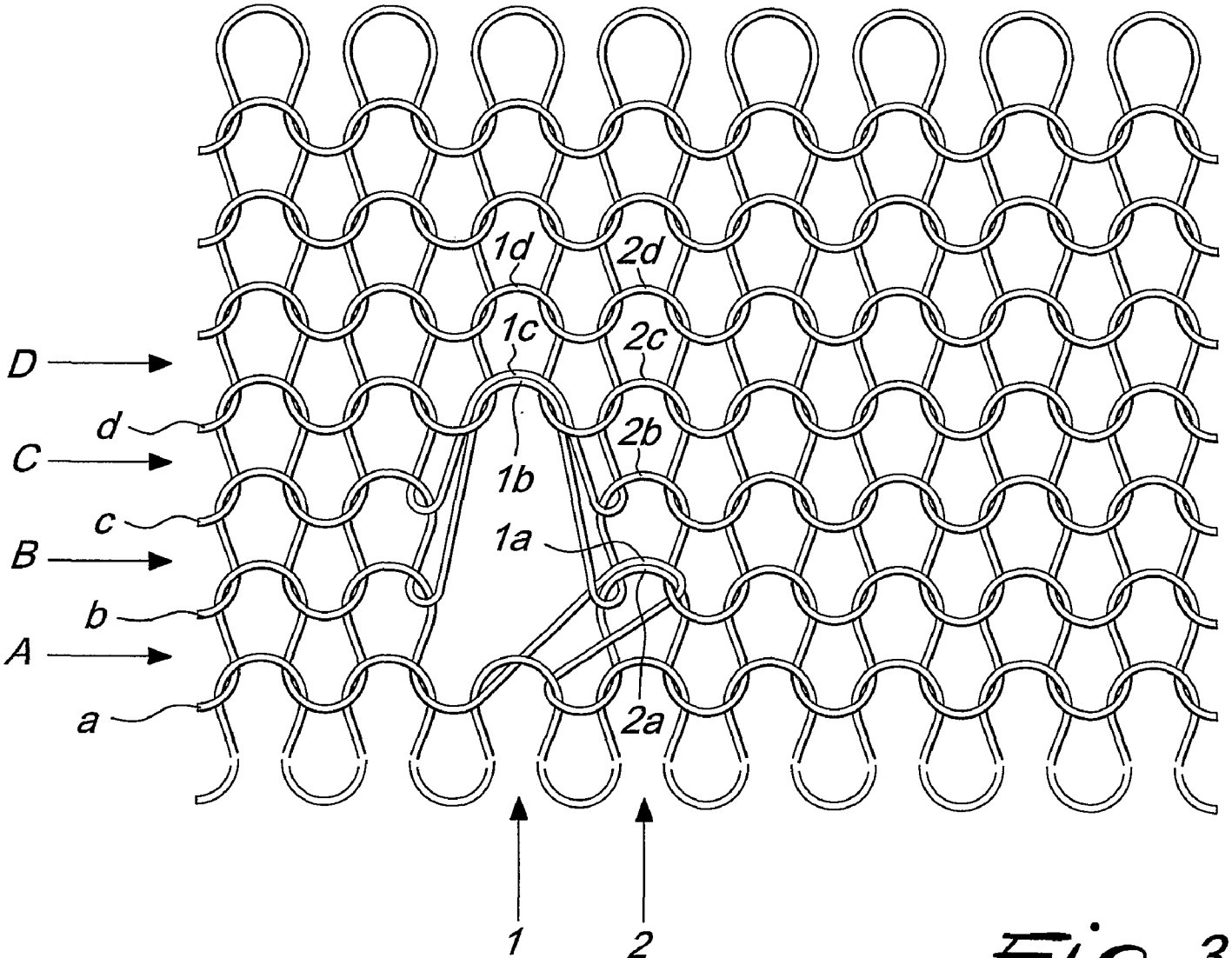

The hole shown in FIG. 3 is obtained, during the formation of the knitting, by using a group of needles that is again constituted by two needles, respectively a first needle 1 and a second needle 2, which are contiguous.

In order to form said hole, the first needle 1, after taking part, together with other needles, in the formation of a first row of knitting A with a thread "a", is freed from the loop 1*a*, formed during the formation of said row of knitting A, by transferring the loop 1*a* onto the second needle 2, which in this manner carries its own loop 2*a* and the loop 1*a*.

After the first loop A, a second row of knitting B is formed by means of a thread "b" by actuating, together with the other needles that take part in the formation of the row of knitting B, also the first needle 1 and the second needle 2, which form respective loops 1*b* and 2*b*. The first needle 1 and the second needle 2, during the engagement of the thread "b", are raised to the drop-stitch level, so that the loops 1*a* and 2*a* pass below the latch of the second needle 2. The formation of the loop 1*b* following the descent of the needle 1, since the needle 1 is free, does not form an actual stitch, but simply forms a so-called "bend", while the formation of the loop 2*b* drops the loops 1*a*, 2*a* with which the loop 2*b* is knitted in.

A third row of knitting C is then formed with a thread "c", which is knitted not only by other needles that take part in the formation of the row of knitting C but also by both needles 1 and 2. During the formation of this row of knitting C, the first needle 1 is lifted to engage the thread "c" at a tuck-stitch level, so that the loop 1*b* does not pass below its latch, while the second needle 2 is lifted to engage the thread "c" at a drop-stitch level, so that the loop 2*b* passes below its latch. The subsequent lowering of said needles 1 and 2 produces the formation of a loop 1*c*, with the loop 1*b* tucked thereon, on the part of the needle 1, and of a loop 2*c* on the part of the needle 2 that drops the loop 2*b*.

After the third row of knitting C, a fourth row of knitting D is formed with a thread "d", which is knitted not only by other needles that take part in the formation of the row of knitting D but also by both needles 1 and 2, which are lifted to engage the thread "d" at a drop-stitch level, so that the loops 1*b*, 1*c* on the needle 1 and 2*c* on the needle 2 pass below the latch of the corresponding needle. The subsequent lowering of said needles 1 and 2 forms two loops 1*d* and 2*d*, which are knitted in respectively with the loops 1*b*, 1*c* and 2*c*, which are dropped by said needles. At this point, the hole shown in FIG. 3 is completed.

Figure 4:
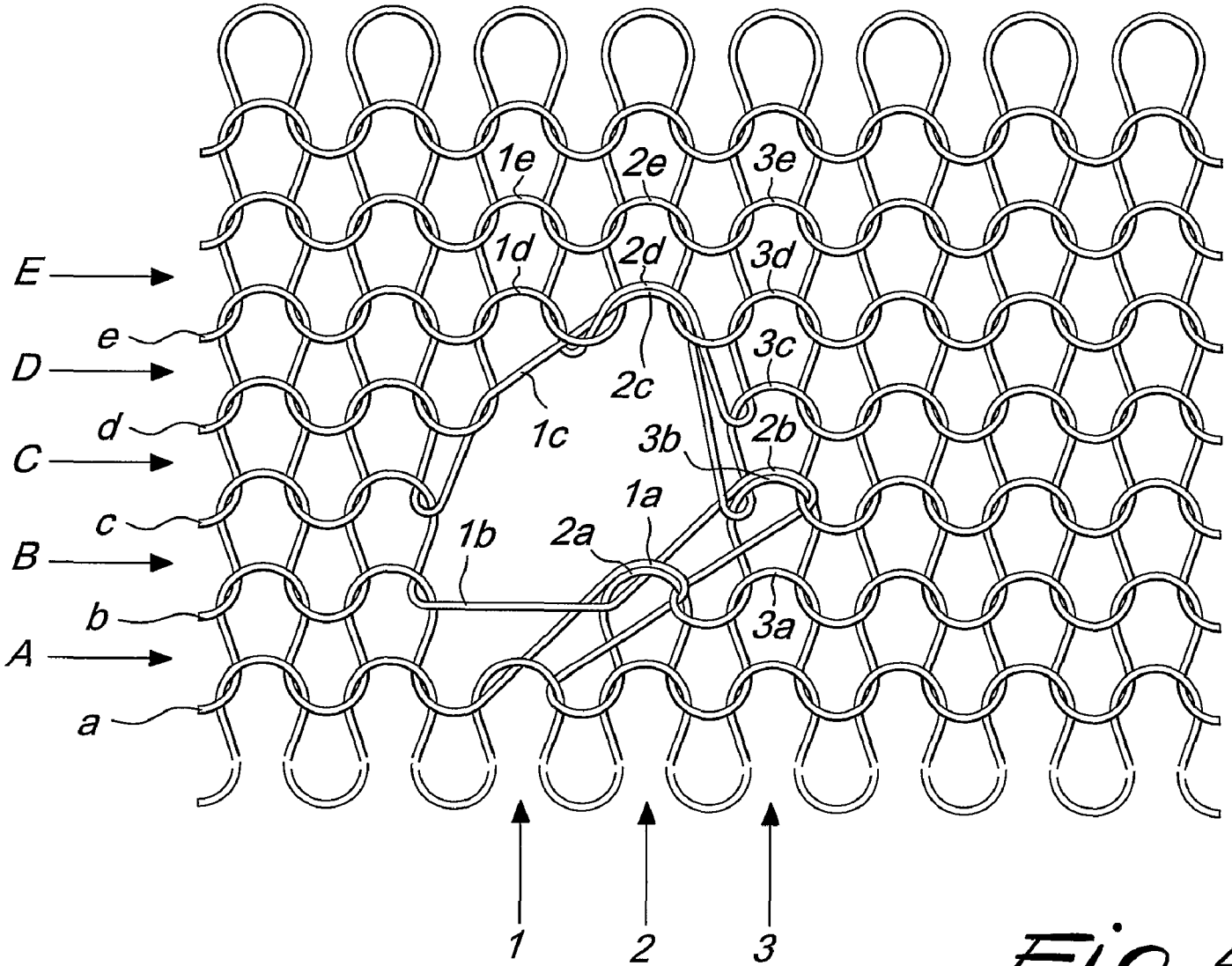

The hole shown in FIG. 4 is obtained, during the formation of the knitting, by using a group of needles constituted by three needles, respectively a first needle 1, a second needle 2, and a third needle 3, which are contiguous.

In order to form said hole, the first needle 1, after taking part together with other needles in the formation of a first row of knitting A with a thread "a", is freed from the loop 1*a*, formed during the formation of said row of knitting A, by way of the transfer of the loop 1*a* onto the second needle 2, which in this manner carries its own loop 2*a* and the loop 1*a*, while the third needle 3 carries the corresponding loop 3*a*.

After the first row of knitting A, a second row of knitting B is formed by means of a thread "b". The first needle 1 is excluded from the knitting of the second row of knitting B, while the second needle 2 and the third needle 3 are actuated together with the other needles that take part in forming the row of knitting B. In this manner, a bridle 1*b* is formed at the first needle 1, while the second needle 2 and the third needle 3 form respective loops 2*b* and 3*b*. The second needle 2, during the engagement of the thread "b", is lifted to the drop-stitch level, so that the loops 1*a* and 2*a* pass below the latch of the second needle 2. The formation of the loop 2*b* drops the loops 1*a*, 2*a* with which the loop 2*b* is knitted in. After forming the second row of knitting B, the second needle 2 also is freed from the loop 2*b*, which is transferred onto the third needle 3, which in this manner carries the loops 2*b* and 3*b*.

A third row of knitting C is then formed with a thread "c" that is knitted not only by other needles that take part in the formation of the row of knitting C but also by the needles 1, 2 and 3, which are lifted to engage the thread "c" at a drop-stitch level, so that the loops 2*b* and 3*b* pass below the latch of the third needle 3. The subsequent descent of the needles forms three loops 1*c*, 2*c*, 3*c*. The formation of the loops 1*c* and 2*c* as a consequence of the descent of the needles 1 and 2, since said needles are free, forms two "bends", while the formation of the loop 3*c* causes the third needle 3 to drop the loops 2*b*, 3*b*.

After the third row of knitting C, a fourth row of knitting D is formed with a thread "d", which is knitted not only by other needles that take part in the formation of the row of knitting D but also by the needles 1, 2 and 3. The needles 1 and 3 are lifted, in order to engage the thread "d", to a drop-stitch level so that the loops 1*c* and 3*c* pass below the latch of the corresponding needle. The subsequent lowering of said needles 1 and 3 forms two loops 1*d* and 3*d*, which are knitted in respectively with the loops 1*c* and 3*c*, which are dropped by said needles. The second needle 2, in order to engage the thread "d", is raised to a tuck-stitch level, so that the loop 2*c* does not pass below the latch of said needle. The subsequent lowering of the second needle 2 forms a loop 2*d*, retaining the loop 2*c* in the beak of said needle.

After the fourth row of knitting D, a fifth row of knitting E is formed with a thread "e", which is knitted not only by other needles that take part in the formation of the row of knitting E but also by the needles 1, 2 and 3. The needles 1, 2 and 3 are lifted, in order to engage the thread "e", to a drop-stitch level so that the loops 1*d*, 2*c*, 2*d* and 3*d* pass below the latch of the corresponding needle. The subsequent lowering of said needles 1, 2 and 3 forms three loops 1*e*, 2*e* and 3*e*, which are knitted in respectively with the loop 1*d*, with the loops 2*c*, 2*d* and with the loop 3*d*, which are dropped by said needles.

At this point, the hole shown in FIG. 4 is complete.

Figure 5:
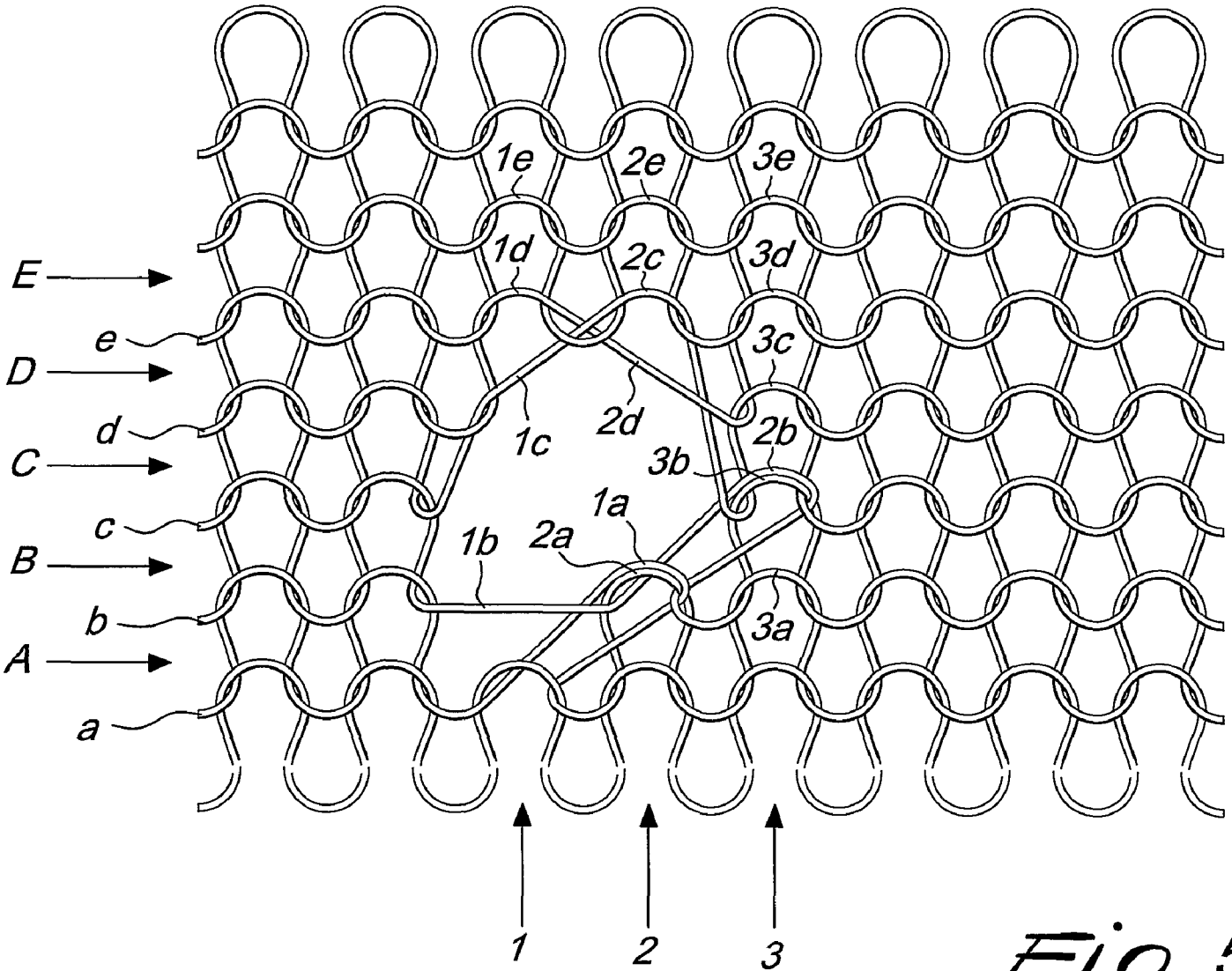

The hole shown in FIG. 5 is obtained, during the formation of the knitting, by using a group of needles constituted by three needles, respectively a first needle 1, a second needle 2, and a third needle 3, which are contiguous.

In order to form said hole, the first needle 1, after taking part together with other needles in the formation of a first row of knitting A with a thread "a", is freed from the loop 1*a*, formed during the formation of said row of knitting A, by transferring the loop 1*a* onto the second needle 2, which in this manner carries its own loop 2*a* and the loop 1*a*, while the third needle 3 carries the corresponding loop 3*a*.

After the first row of knitting A, a second row of knitting B is formed by means of a thread "b". The first needle 1 is excluded from the knitting of the second row of knitting B, while the second needle 2 and the third needle 3 are actuated together with the other needles that take part in the formation of the row of knitting B. In this manner, a bridle 1*b* forms at the first needle 1, while the second needle 2 and the third needle 3 form respective loops 2*b* and 3*b*. The second needle 2, during the engagement of the thread b, is lifted to the drop-stitch level, so that the loops 1*a* and 2*a* pass below the latch of the second needle 2. The formation of the loop 2*b* unloads the loops 1*a*, 2*a* with which the loop 2*b* is knitted in. After the formation of the second row of knitting B, the second needle 2 also is freed from the loop 2*b*, which is transferred onto the third needle 3, which in this manner carries the loops 2*b* and 3*b*.

A third row of knitting C is then formed with a thread "c", which is knitted not only by other needles that take part in the formation of the row of knitting C but also by the needles 1, 2 and 3, which are lifted in order to engage the thread "c" at a drop-stitch level, so that the loops 2*b* and 3*b* pass below the latch of the third needle 3. The subsequent lowering of the needles forms three loops 1*c*, 2*c*, 3*c*. The formation of the loops of knitting 1*c* and 2*c* following the descent of the needles 1 and 2, since said needles were free, forms two "bends", while the formation of the loop 3*c* makes the third needle 3 drop the loops 2*b*, 3*b*.

After the third row of knitting C, a fourth row of knitting D is formed with a thread d, which is knitted not only by other needles that take part in the formation of the row of knitting D but also by the needles 1 and 3, while the needle 2 is excluded from knitting and retains, in its beak, the loop 2*c* formed previously. The needles 1 and 3 are lifted, in order to engage the thread d, to a drop-stitch level, so that the loops 1*c* and 3*c* pass below the latch of the corresponding needle. The subsequent lowering of said needles 1 and 3 forms two loops 1*d* and 3*d*, which are knitted in respectively with the loops 1*c* and 3*c*, which are dropped by said needles. A bridle 2*d* is formed at the needle 2 excluded from knitting.

After the fourth row of knitting D, a fifth row of knitting E is formed with a thread e, which is knitted not only by other needles that take part in the formation of the row of knitting E but also by the needles 1, 2 and 3. The needles 1, 2 and 3 are lifted in order to engage the thread e; at a drop-stitch level, so that the loops 1*d*, 2*c* and 3*d* pass below the latch of the corresponding needle. The subsequent lowering of said needles 1, 2 and 3 forms three loops 1*e*, 2*e* and 3*e*, which are knitted in respectively with the loop 1*d*, with the loop 2*c* and with the loop 3*d*, which are dropped by said needles.

At this point, the hole shown in FIG. 5 is complete.

Figure 6:
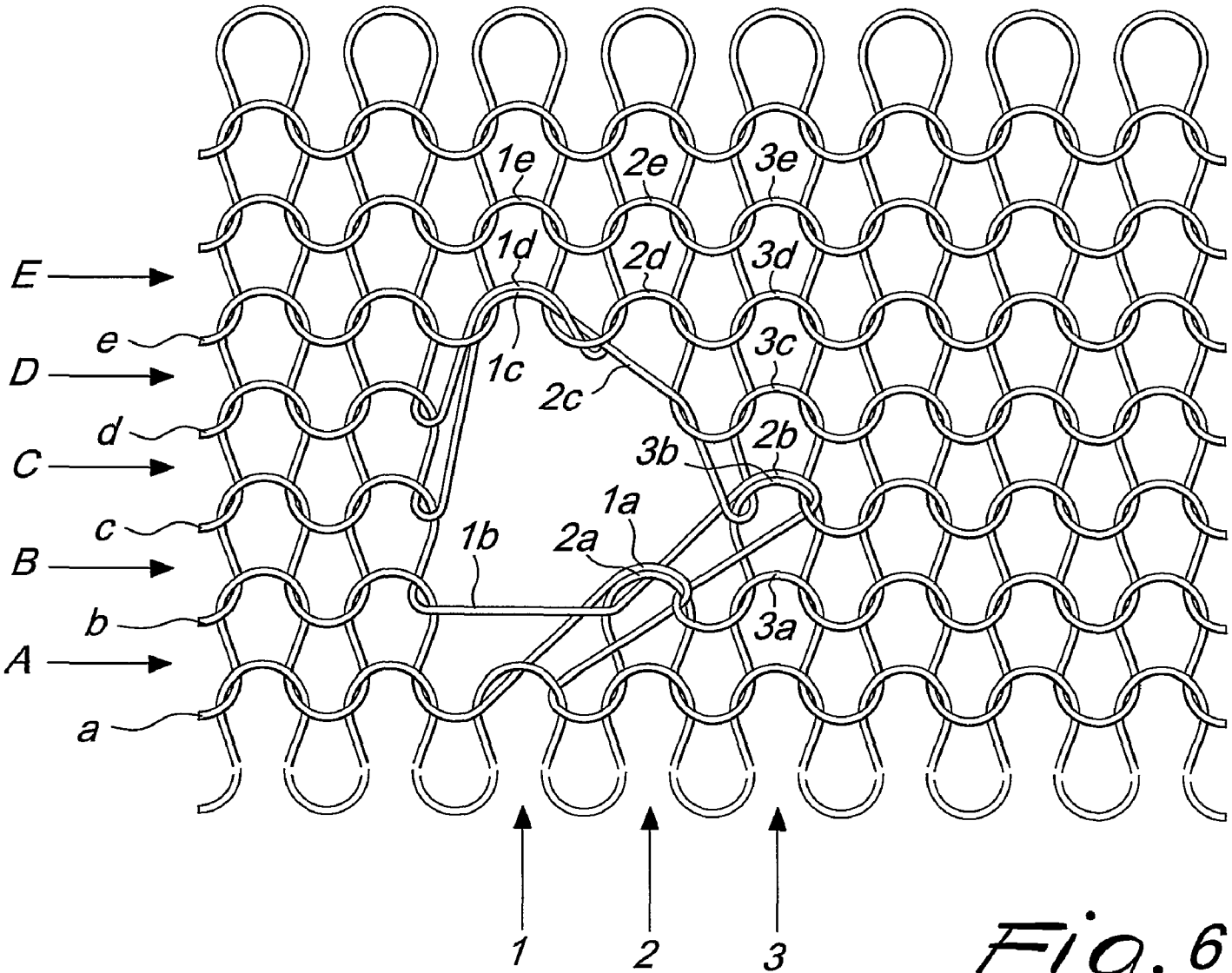

The hole shown in FIG. 6 is obtained, during the formation of the knitting, by using a set of needles constituted by three needles, respectively a first needle 1, a second needle 2, and a third needle 3, which are contiguous.

In order to form said hole, the first needle 1, after taking part together with other needles in the formation of a first row of knitting A with a thread "a", is freed from the loop 1*a* formed during the formation of said row of knitting A, which in this manner, by way of the transfer of the loop 1*a* onto the second needle 2, which in this manner carries its own loop 2*a* and the loop 1*a*, while the third needle 3 carries the corresponding loop 3*a*.

After the first row of knitting A, a second row of knitting B is formed by means of a thread "b". The first needle 1 is excluded from knitting the second row of knitting B, while the second needle 2 and the third needle 3 are actuated together with the other needles that take part in the formation of the row of knitting B. In this manner, a bridle 1*b* forms at the first needle 1, while the second needle 2 and the third needle 3 form respective loops 2*b* and 3*b*. The second needle 2, during the engagement of the thread "b", is raised to the drop-stitch level, so that the loops 1*a* and 2*a* pass below the latch of the second needle 2. The formation of the loop 2*b* drops the loops 1*a*, 2*a* with which the loop 2*b* is knitted in. After the formation of the second loop B, the second needle 2 also is freed from the loop 2*b*, which is transferred onto the third needle 3, which in this manner carries the loops 2*b* and 3*b*.

Subsequently, a third row of knitting C is formed with a thread "c", which is knitted not only by other needles that take part in the formation of the row of knitting C but also by the needles 1, 2 and 3, which are raised to engage the thread "c" at a drop-stitch level, so that the loops 2*b* and 3*b* pass below the latch of the third needle 3. The subsequent lowering of the needles forms three loops 1*c*, 2*c*, 3*c*. The formation of the loops 1*c* and 2*c* as a consequence of the descent of the needles 1 and 2, since said needles are free, forms two "bends", while the formation of the loop 3*c* makes the third needle 3 drop the loops 2*b*, 3*b*.

After the third row of knitting C, a fourth row of knitting D is formed with a thread "d", which is knitted not only by other needles that take part in the formation of the row of knitting D but also by the needles 1, 2 and 3. The needles 2 and 3 are raised, in order to engage the thread "d", at a drop-stitch level, so that the loops 2*c* and 3*c* pass below the latch of the corresponding needle. The subsequent lowering of said needles 2 and 3 forms two loops 2*d* and 3*d*, which are knitted in respectively with the loops 2*c* and 3*c*, which are dropped by said needles. The first needle 1, in order to engage the thread "d", is raised to a tuck-stitch level, so that the loop 1*c* does not pass below the latch of said needle. The subsequent lowering of the first needle 1 forms a loop 1*d*, with retention of the loop 1*c* in the beak of said needle.

After the fourth row of knitting D, a fifth row of knitting E is formed with a thread "e", which is knitted not only by other needles that take part in the formation of the row of knitting E but also by the needles 1, 2 and 3. The needles 1, 2 and 3 are raised, in order to engage the thread "e", to a drop-stitch level, so that the loops 1*c*, 1*d*, 2*d* and 3*d* pass below the latch of the corresponding needle. The subsequent lowering of said needles 1, 2 and 3 forms three loops 1*e*, 2*e*, and 3*e*, which are knitted in respectively with the loops 1*c*, 1*d*, with the loop 2*d*, and with the loop 3*d*, which are dropped by said needles.

At this point, the hole shown in FIG. 6 is complete.

Figure 7:
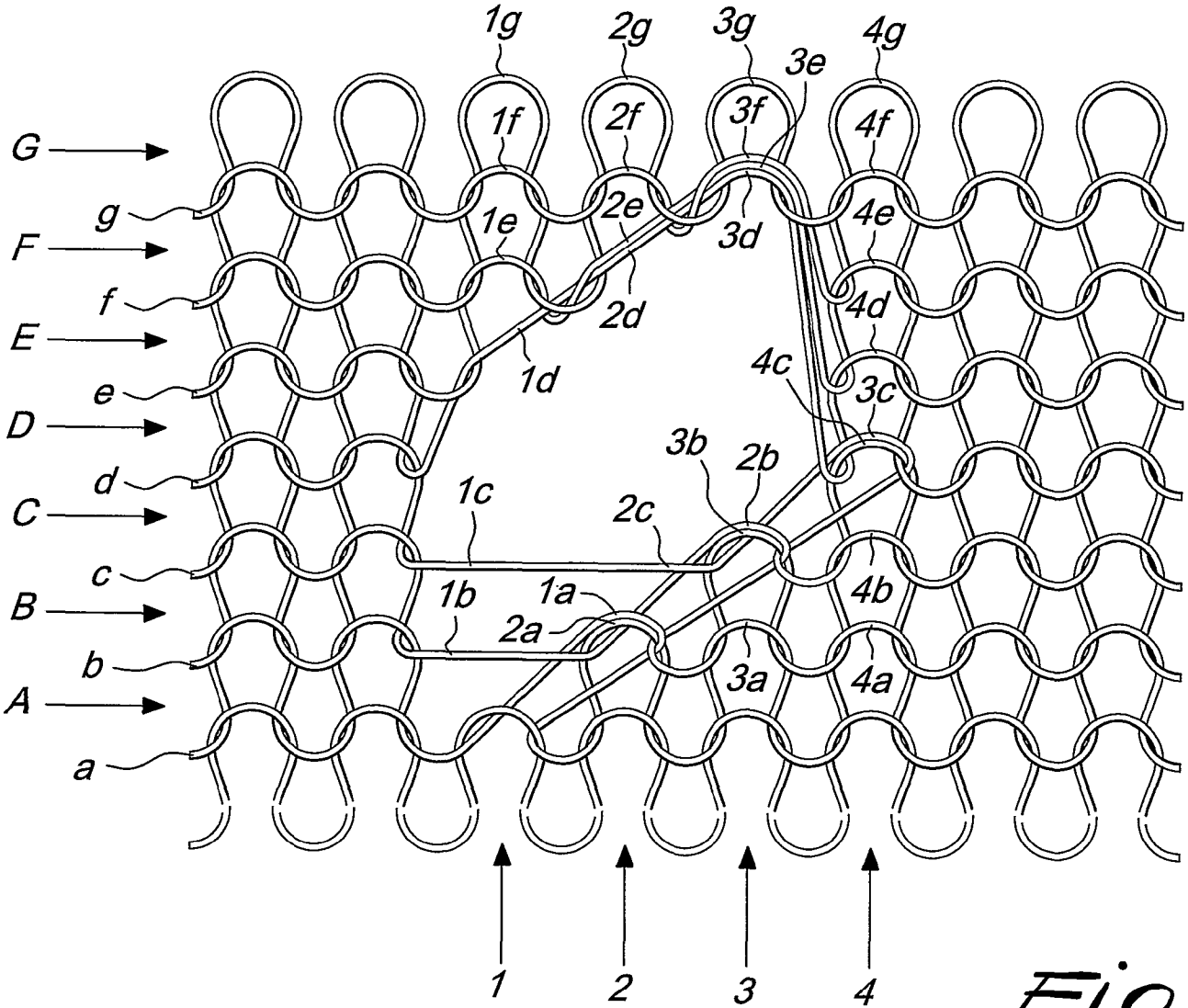

The hole shown in FIG. 7 is obtained, during the formation of the knitting, by using a group of needles constituted by four needles, respectively a first needle 1, a second needle 2, a third needle 3 and a fourth needle 4, which are contiguous.

In order to form said hole, the first needle 1, after taking part, together with other needles, in the formation of a first row of knitting A with a thread "a", is freed from the loop 1*a*, formed during the formation of said row of knitting A, by way of the transfer of the loop 1*a* onto the second needle 2, which in this manner carries its own loop 2*a* and the loop 1*a*, while the third needle 3 carries the corresponding loop 3*a* and the fourth needle carries the corresponding loop 4*a*.

After the first row of knitting A, a second row of knitting B is formed by means of a thread "b". The first needle 1 is excluded from the knitting of the second row of knitting B, while the second needle 2, the third needle 3 and the fourth needle 4 are actuated together with the other needles that take part in the formation of the row of knitting B. In this manner, a bridle 1*b* forms at the first needle 1, while the second needle 2, the third needle 3 and the fourth needle 4 form respective loops 2*b*, 3*b* and 4*b*. The second needle 2, during the engagement of the thread "b", is raised to the drop-stitch level, so that the loops 1*a* and 2*a* pass below the latch of the second needle 2. The formation of the loop 2*b* drops the loops 1*a*, 2*a* with which the loop 2*b* is knitted in. After the formation of the second row of knitting B, the second needle 2 also is freed from the loop 2*b*, which is transferred onto the third needle 3, which in this manner carries the loops 2*b* and 3*b*.

After the second row of knitting B, a third row of knitting C is formed by means of a thread "c". The first needle 1 remains excluded from the knitting also of the third row of knitting C, and the second needle 2 is also excluded from knitting, while the third needle 3 and the fourth needle 4 are actuated together with the other needles that take part in the formation of the row of knitting C. In this manner, bridles 1*c* and 2*c* form at the first needle 1 and at the second needle, while the third needle 3 and the fourth needle 4 form respective loops 3*c* and 4*c*. The third needle 3, during the engagement of the thread "c", is raised to the drop-stitch level, so that the loops 2*b* and 3*b* pass below the latch of the third needle 3. The formation of the loop 3*c* drops the loops 2*b*, 3*b* with which the loop 3*c* is knitted in. After forming the third row of knitting C, the third needle 3 also is freed from the loop 3*c*, which is transferred onto the fourth needle 4, which in this manner carries the loops 3*c* and 4*c*.

A fourth row of knitting D is then formed with a thread "d", which is knitted not only by other needles that take part in the formation of the row of knitting D but also by the needles 1, 2, 3 and 4, which are raised to engage the thread "d" at a drop-stitch level, so that the loops 3*c* and 4*c* pass below the latch of the fourth needle 4. The subsequent lowering of the needles forms four loops 1*d*, 2*d*, 3*d* and 4*d*. The formation of the loops 1*d*, 2*d* and 3*d* following the descent of the needles 1, 2 and 3, since said needles are free, forms three "bends", while the formation of the loop 4*d* makes the fourth needle 4 drop the loops 3*c* and 4*c*.

After the fourth row of knitting D, a fifth row of knitting E is formed with a thread "e", which is knitted not only by other needles that take part in the formation of the row of knitting E but also by the needles 1, 2, 3 and 4. The needle 1 and the needle 4 are raised to engage the thread "e" at a drop-stitch level so that the loops 1*d* and 4*d* pass below the latch of the corresponding needle. The subsequent lowering of said needles 1 and 4 forms two loops 1*e* and 4*e*, which are knitted in respectively with the loops 1*d* and 4*d*, which are dropped by said needles. The second needle 2 and the third needle 3, in order to engage the thread "e", are lifted to a tuck-stitch level so that the corresponding loops 2*d*, 3*d* do not pass below the latch of said needles. The subsequent lowering of said needles 2 and 3 forms loops 2*e*, 3*e*, with retention of the loops 2*d*, 3*d* in the beak of said needles.

After the fifth row of knitting E, a sixth row of knitting F is formed with a thread "f", which is knitted not only by other needles that take part in the formation of the row of knitting F but also by the needles 1, 2, 3 and 4. The needles 1, 2 and 4 are raised, in order to engage the thread "f", to a drop-stitch level so that the loops 1*e*, 2*d*, 2*e* and 4*e* pass below the latch of the corresponding needle. The subsequent lowering of said needles 1, 2 and 4 forms three loops 1*f*, 2*f* and 4*f*, which are knitted in respectively with the loop 1*e*, with the loops 2*d* and 2*e*, and with the loop 4*e*, which are dropped by said needles. The third needle 3, in order to engage the thread "f", is raised to a tuck-stitch level so that the loops 3*d*, 3*e* do not pass below the latch of said needle. The subsequent lowering of the needle 3 forms a loop 3*f*, with retention of the loops 3*d*, 3*e* in the beak of said needle.

After the sixth row of knitting F, a seventh row of knitting G is formed with a thread "g", which is knitted not only by other needles that take part in the formation of the row of knitting G but also by the needles 1, 2, 3 and 4. The needles 1, 2, 3 and 4 are raised, in order to engage the thread "g", to a drop-stitch level so that the loops 1*f*, 2*f*, 3*d*, 3*e*, 3*f* and 4*f* pass below the latch of the corresponding needle. The subsequent lowering of said needles 1, 2, 3 and 4 forms four loops 1*g*, 2*g*, 3*g* and 4*g*, which are knitted in respectively with the loop 1*f*, with the loop 2*f*, with the loops 3*d*, 3*e*, 3*f*, and with the loop 4*f*, which are dropped by said needles.

At the point, the hole shown in FIG. 7 is complete.

In the description of the method for forming the various holes, it has been stated that when knitting resumes, the needles that had been freed by transferring the loop onto the contiguous needle are raised to a drop-stitch level. Although this constitutes the preferred manner, since it avoids actuating said needles in a diversified manner with respect to the contiguous needles that must form new loops and drop the loops received or formed previously, it is not a binding aspect, and said needles can resume knitting also by means of a lifting to the tuck-stitch level, since by being free there is no problem of dropping or retaining previously formed or received loops.

The embodiments described have been given merely by way of non-limiting example, in order to better explain the underlying concept of the invention. By following the teaching on which the invention is based, it is possible to perform openwork with holes whose dimensions and shapes can be varied simply by:

varying the number of needles gradually freed by transferring their loop to a contiguous needle;

varying the number of rows of knitting during which said needles are excluded from knitting; and varying the type of stitch formed by said needles when they are moved to knit again.

The description given above regarding the execution of the holes has been restricted to the actuation of the group of needles used to form the hole. The actuation of the other needles of the machine in the formation of the various rows of knitting to form the regions of knitting that are contiguous to the hole may be any, depending on the requirements, although preference is given, in the vicinity of the holes, to plain knitting, as shown in the figures.

Obviously, in the production of a knitted article, the holes that can be obtained with the method according to the invention can be repeated several times in the production of the article, and holes having different shapes and/or dimensions may be optionally combined in various manners, depending on the aesthetic effect to be obtained.

The method according to the invention is performed preferably with a machine of the type disclosed in the published patent document WO-02/070799, but can be performed in any case with other machines that allow to transfer a loop from one needle to a contiguous needle.

In practice, it has been found that the method according to the invention fully achieves the intended aim, since by using the technique of transferring the loop from one needle to a contiguous needle in combination with the formation of conventional stitches, it allows to form open-knit fabric with holes that have various dimensions and/or shapes according to the requirements.

In the examples of embodiments described above, individual characteristics, given in relation to specific examples, may actually be interchanged with other different characteristics that exist in other examples of embodiments.

The method and the open-knit article obtained with the method, thus conceived, are susceptible of numerous modifications and variations, all of which are within the scope of the appended claims; all the details may further be replaced with other technically equivalent ones.

In practice, the threads and the counts of the threads that are used may be any according to requirements and to the state of the art.

The disclosures in Italian Patent Application No. MI2004A000303 from which this application claims priority are incorporated herein by reference.

Where technical features mentioned in any claim are followed by reference signs, those reference signs have been included for the sole purpose of increasing the intelligibility of the claims and accordingly, such reference signs do not have any limiting effect on the interpretation of each element identified by way of example by such reference signs.

What is claimed is:

1. A method for producing open-knit fabric with machines for knitting articles provided with a plurality of needles, said open-knit fabric comprising holes, the method consisting in:

actuating said plurality of needles for forming, in succession, rows of knitting, and, in order to obtain a hole in said open-knit fabric:

after having formed a first row of knitting, transferring a loop of the first row of knitting formed by a first needle to a second needle that is contiguous to said first needle, so as to free said first needle from said loop, in a formation of a second row of knitting adjacent to said first row of knitting, excluding said first needle from knitting in order to form a float loop at said first needle, after having formed the second row of knitting, transferring the loop that is formed be said second needle and belongs to said second row of knitting to a third needle that is contiguous to said second needle, so as to free said second needle as well, actuating said first needle and said second needle so as to resume knitting and forming new loops of a third row of knitting that is subsequent to said second row.

2. The method according to claim 1, wherein when said first needle is actuated to resume knitting after transfer of the loop, the first needle is actuated so as to form at least one tuck stitch.

3. The method according to claim 1, comprising repeating operation for transferring a loop to a needle that is contiguous to the one that received the loop of the preceding row for a preset number of rows, freeing in each instance a needle, while the needles freed by the transfer of the loop in a preceding row are excluded from knitting during a formation of a preset number of rows of knitting, the needles excluded from the knitting of said preset number of rows resuming knitting by formation a new row of knitting after said preset number of rows of knitting.

4. The method according to claim 3, comprising actuation, when knitting with needles freed by the transfer of the loop resumes, of at least one of said freed needles to form a tuck stitch.

5. The method according to claim 3, comprising actuation of the needles freed by the transfer of the loop to resume knitting by forming new loops in the formation of successive different rows of knitting.

6. The method according to claim 3, comprising knitting of regions adjacent to said holes with plain stitches.

7. The method according to claim 1 performed with a machine that allows to transfer a loop from one needle to a contiguous needle.

8. An open-knit article obtained according to the method of claim 1.

* * * * *